US011445751B2

(12) United States Patent
Wu et al.

(10) Patent No.: US 11,445,751 B2
(45) Date of Patent: Sep. 20, 2022

(54) PORTABLE SMOKING STORAGE CASE

(71) Applicant: FUEMZ CORP., North York (CA)

(72) Inventors: Henry Wu, North York (CA); Alan Chong, North York (CA)

(73) Assignee: FUEMZ CORP., North York (CA)

( * ) Notice: Subject to any disclaimer, the term of this patent is extended or adjusted under 35 U.S.C. 154(b) by 0 days.

(21) Appl. No.: 17/298,644

(22) PCT Filed: Dec. 10, 2019

(86) PCT No.: PCT/CA2019/051774
§ 371 (c)(1),
(2) Date: May 31, 2021

(87) PCT Pub. No.: WO2020/118423
PCT Pub. Date: Jun. 18, 2020

(65) Prior Publication Data

US 2022/0000174 A1 Jan. 6, 2022

(30) Foreign Application Priority Data

Dec. 10, 2018 (CA) ..... CA 3026940

(51) Int. Cl.
*A24F 15/10* (2006.01)

(52) U.S. Cl.
CPC ..... *A24F 15/10* (2013.01)

(58) Field of Classification Search
CPC ..... A24F 15/08; A24F 15/10; A24F 40/95
See application file for complete search history.

(56) References Cited

U.S. PATENT DOCUMENTS

| | | | | |
|---|---|---|---|---|
| 6,012,459 | A | 1/2000 | Keefe | |
| 6,328,555 | B1 * | 12/2001 | Park | F23Q 2/164 431/152 |
| 2012/0062169 | A1 * | 3/2012 | Reymann | H01M 10/46 320/107 |
| 2016/0091194 | A1 * | 3/2016 | Liu | F21V 33/0004 206/236 |

FOREIGN PATENT DOCUMENTS

| | | | |
|---|---|---|---|
| CN | 106235407 | A | 12/2016 |
| KR | 200272376 | Y1 | 4/2002 |
| WO | 2011133068 | A1 | 10/2011 |

* cited by examiner

*Primary Examiner* — Michael J Felton
*Assistant Examiner* — Yana B Krinker
(74) *Attorney, Agent, or Firm* — Weisun Rao; Sunyong Tang; Venture Partner, LLC

(57) ABSTRACT

A portable smoking storage case for storing and using a substance for recreational or medical use is disclosed. The case comprises a body and a lid attached to a side of the body. Located within the body are a built-in rechargeable battery to power a built-in lighter that is connected to a control unit activating the lighter, a compartment for storing tools needed to use the substance, a removable container having a sealable stopper for storing the substance, and a built-in safety mechanism that is connected to a trigger switch on the control unit to prevent accidental activation of the lighter when the lid closes. The trigger switch is activated through a contact communication with the lid when the lid opens, which in turn disables the built-in safety mechanism.

11 Claims, 8 Drawing Sheets

PORTABLE SMOKING STORAGE CASE

CROSS-REFERENCE TO RELATED APPLICATIONS

This application is the US national phase of International Application No. PCT/CA2019/051774, filed on Dec. 10, 2019, which claims priority to Canadian patent application number 3,026,940, filed on Dec. 10, 2018, the entirety of the contents of which is incorporated herein by reference.

TECHNICAL FIELD

This disclosure relates to portable storage containers. More particularly, the present disclosure relates to a portable smoking storage case for storing both legal substances and the tools needed to prepare the legal substances for recreational or medical use.

BACKGROUND

Legal substances such as marijuana (also known as *cannabis*), tobacco and other tobacco substitutes such as herbs, may need to be grinded and/or hand rolled into a cigarette or a joint before they can be enjoyed for recreational or medical purposes. For legal substances in loose forms, a few tools are usually needed to prepare the loose substances into hand rolled cigarettes or joints for use. For example, to make a marijuana joint, a user will need a grinder, rolling papers, lighter and possibly other additional tools depending on that user's particular preference. If the user wishes to prepare the legal substance quickly and easily, it can be inconvenient to gather all of the necessary tools.

Therefore, it is desirable to have a portable all-in-one system that stores not only legal substances, but also any necessary tools so that a user can easily prepare the legal substances with ease and spontaneity.

In addition, certain legal substances, for example, marijuana, have a distinct aroma which may not be pleasant to some people. Some legal substances may also be susceptible to humidity. Hence, it is desirable that the portable all-in-one storage system can store legal substances in a manner that can prevent the leak of the aroma into the surrounding environment and/or can prevent moisture from getting into contact with the substances.

It may also be desirable that the portable all-in-one storage system is compact so that a user can carry it conveniently and discretely.

SUMMARY

In one aspect, a portable storage case for storing both legal substances and the tools needed to prepare the legal substances for recreational or medical use is disclosed. The case comprises a body having an opening end and a bottom end opposite to the opening end. A lid is attached to a side of the body and is configured to cover and uncover the opening end. The case further comprises a built-in rechargeable battery to power a built-in lighter, a compartment for storing tools needed to prepare the legal substance for recreational or medical use, and a removable container having a sealable stopper for storing the substance, all being located in the body. The lighter is connected to a control unit that is located inside the body and connected to a power switch on an outer surface of the body. When the power switch is turned on, the control unit receives an activation signal from the power switch and enables the lighter, and when the power switch is turned off, the control unit receives a deactivation signal from the power switch and disables the lighter. The sealable stopper may provide a scent proof seal.

In another aspect, the portable further comprises a built-in safety mechanism located in the body and connected to a trigger switch on the control unit to prevent accidental activation of the lighter when the lid covers the opening end. The trigger switch is activated through a contact communication with the lid when the lid uncovers the opening end. This in turn disables the built-in safety mechanism.

In another aspect, the built-in safety mechanism comprises a first member connected to the lid and a second member having an inner cavity to receive the first member. The covering of the opening end by the lid lowers the first member into the inner cavity of the second member, causing the trigger switch to lose contact communication with the lid. The uncovering of the opening end raises the first member from the inner cavity of the second member, causing the trigger switch to be in contact communication with the lid.

In another aspect, the first member is an elastic putter encased in a spring.

In another aspect, the bottom end of the body is equipped with a charging port for charging the built-in rechargeable battery to an external power source.

In another aspect, the control unit further comprises a battery level detector to detect the battery level of the built-in rechargeable battery. The body further comprises a battery level display on the outer surface of the body. The battery level detector communicates with the battery level display such that the battery level detected is shown on the display.

In another aspect, the sealable stopper further comprises a smoking tip extending from an underside of the stopper.

In another aspect, the lighter is an electric arc lighter.

In another aspect, the control unit comprises a printed circuit board comprising at least one integrated circuit.

In another aspect, the built-in rechargeable battery to power the lighter and the control unit are located inside the lid, the power switch is on an outer surface of the lid and the removable container is located inside the compartment for storing the tools in the body.

In another aspect, a kit for storing, preparing and using the substance for recreational or medical use is provided. The kit comprises the portable storage case described herein and the tools for preparing and using the legal substance.

BRIEF DESCRIPTION OF THE DRAWINGS

An embodiment will now be described in detail by way of example, with reference to the accompanying drawings in which.

DETAILED DESCRIPTION

Figure 1:
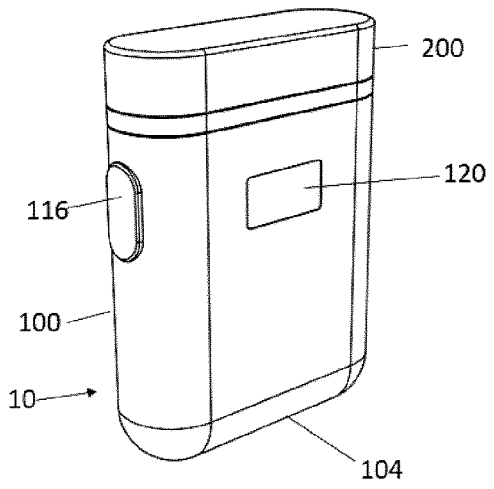
FIG. 1 is a left perspective view of a portable storage case according to one embodiment of the present disclosure.
Figure 2:
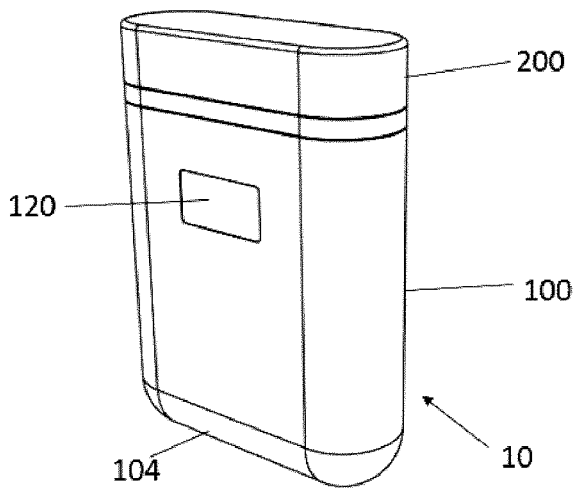
FIG. 2 is a right perspective view of the portable storage case of FIG. 1.
Figure 3:
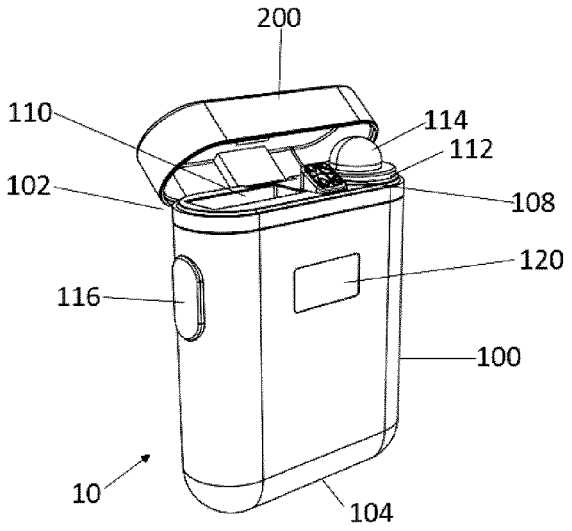
FIG. 3 is a left perspective view of the portable storage case of FIG. 1 with the lid in an open position.
Figure 4:
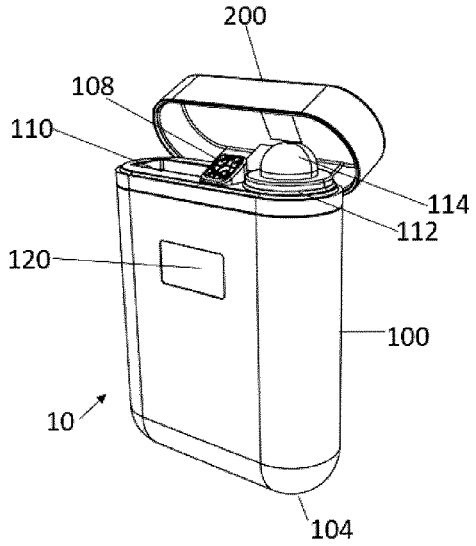
FIG. 4 is a right perspective view of the portable storage case of FIG. 1 with the lid in an open position.
Figure 5:
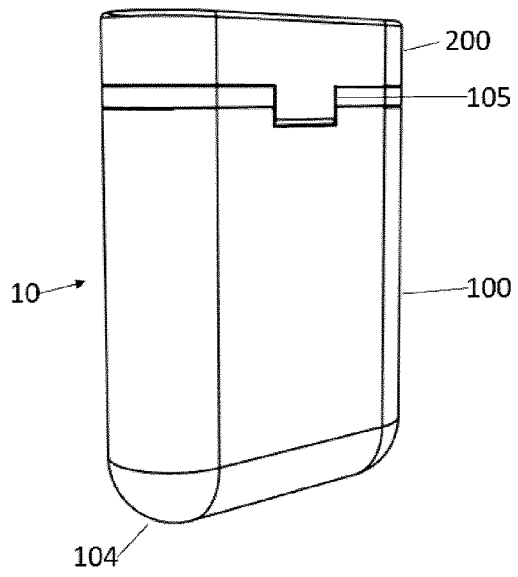
FIG. 5 is a back perspective view of the portable storage case of FIG. 1.
Figure 6:
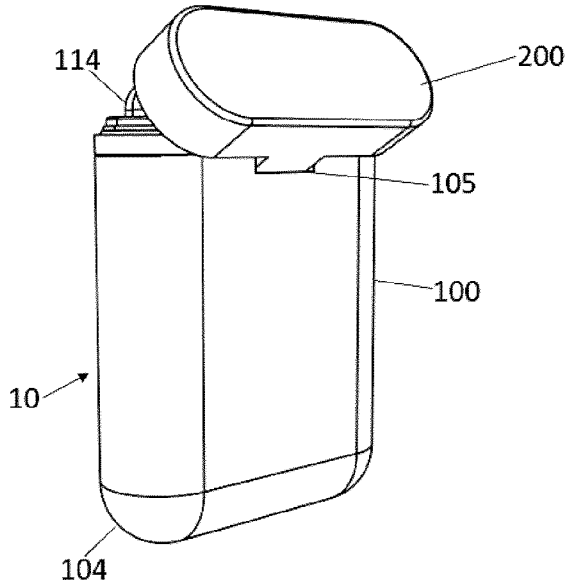
FIG. 6 is a back perspective view of the portable storage case of FIG. 1 with the lid in an open position.
Figure 7:
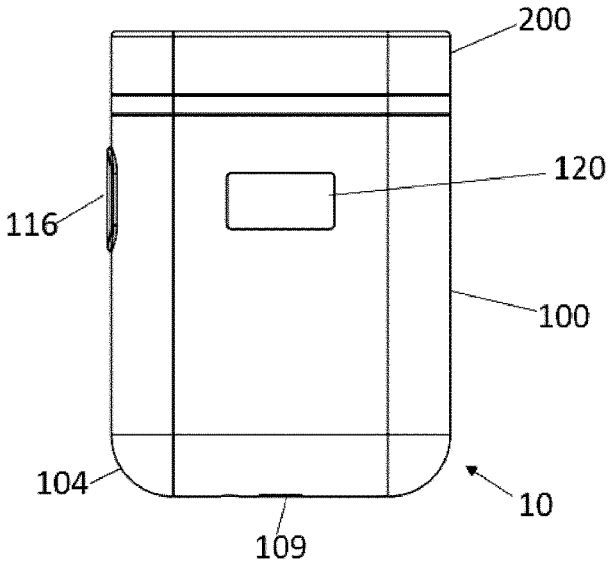
FIG. 7 is a front view of the portable storage case of FIG. 1.
Figure 8:
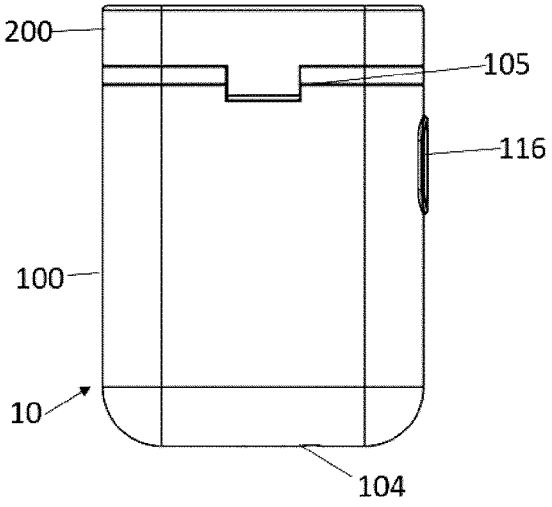
FIG. 8 is a back view of the portable storage case of FIG. 1.
Figure 9A:
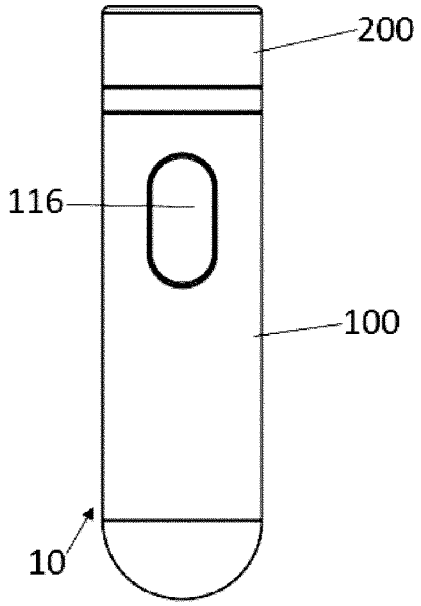
FIGS. 9A and 9B are side views of the portable storage case of FIG. 1.
Figure 9B:
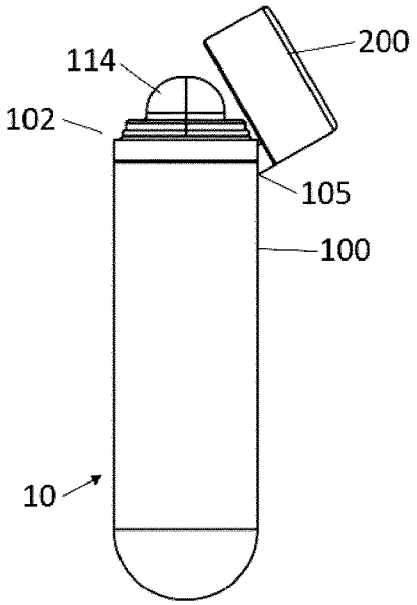
Figure 10A:
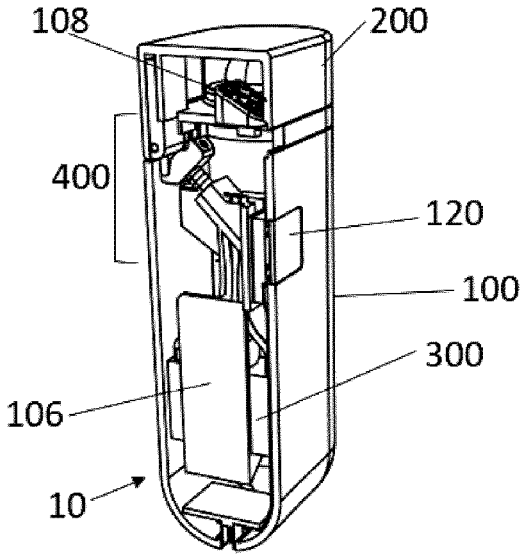
FIGS. 10A and 10B are perspective views of a built-in safety mechanism of the portable storage case of FIG. 1.
Figure 10B:
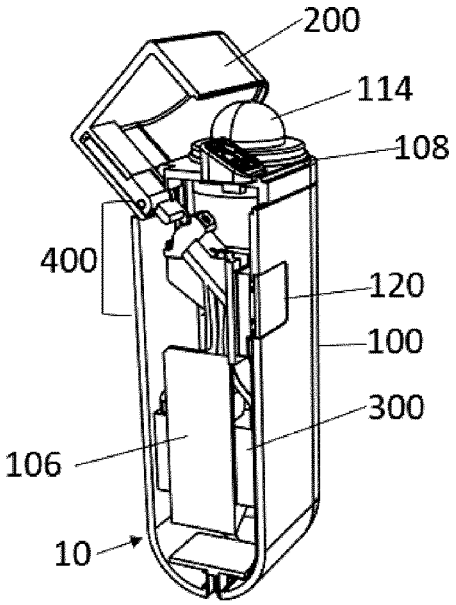
Figure 11A:
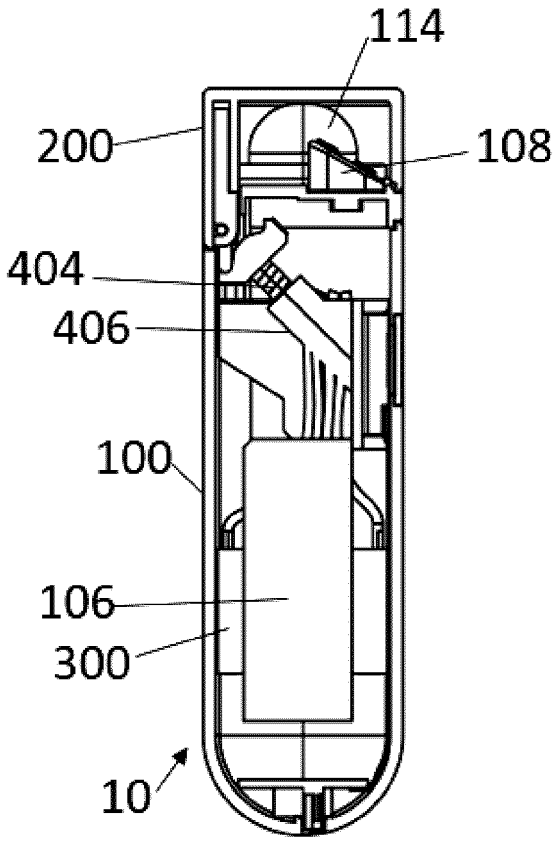
FIGS. 11A and 11B are perspective views of the built-in safety mechanism of FIGS. 10A and 10B.
Figure 11B:
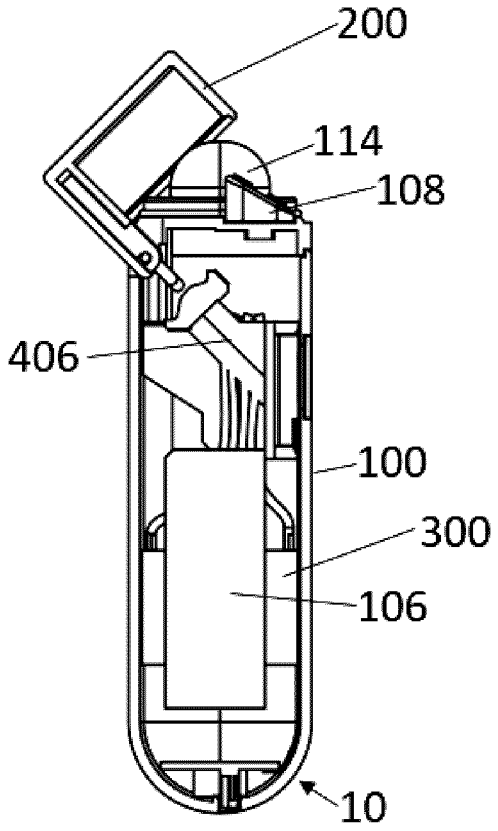
Figure 12A:
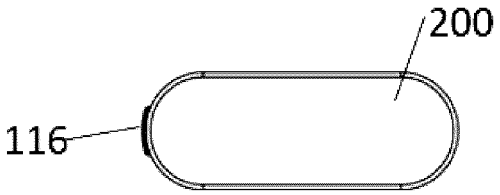
FIGS. 12A and 12B are top views of the portable storage case of FIG. 1 with the lid being closed (FIG. 12A) and being open (FIG. 12B).
Figure 12B:
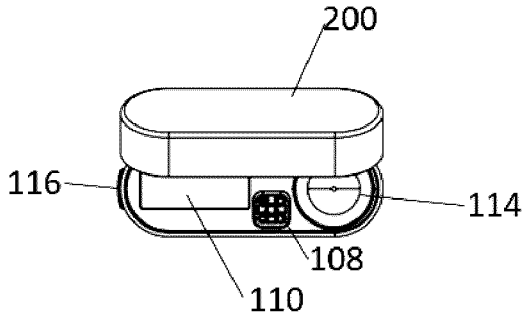

The description, which follows, and the embodiments described therein are provided by way of illustration of an example, or examples of particular embodiments of principles and aspects of the present invention. These examples are provided for the purposes of explanation, and not of limitation, of those principles and of the invention. Numerous specific details are set forth to provide a full understanding of various aspects of the subject disclosure. It will be apparent, however, to one ordinarily skilled in the art that various aspects of the subject disclosure may be practiced without some of these specific details. In other instances, well-known structures and techniques have not been shown in detail to avoid unnecessarily obscuring the subject disclosure.

FIGS. 1 to 11B illustrate a portable storage case 10 for storing a legal substance and one or more tools for preparing the substance for recreational or medical use according to one embodiment. The portable storage case 10 comprises a body 100 having an opening end 102 and a bottom end 104 opposite to the opening end 102. The portable storage case 10 further comprises a lid 200 which is attached to a side of the body 100. The lid 200 is configured cover and uncover the opening end 102. The body 100 and the lid 200 may be attached to the side of the body 100 through a hinge 105. The lid 200 may be connected to the body 100 through any pivoting means known in the art. In one embodiment, the lid 200 and the body 100 are connected magnetically to keep the opening end 102 covered when the portable storage case 10 is not in use. In addition, in some embodiments, edges of the lid 200 and the body 100 are ribbed to allow the user to have a firmer grip around the lid 200 and the body 100 when attempting to remove the lid 200 away from the body 100. Further, edges of the lid 200 and the body 100 are rounded to provide a comfortable grip in some embodiments.

As further illustrated, the body 100 is in the shape of a cigarette carton. However, it should be noted the body 100 can be of any particular shape as would be appreciated by one of ordinary skill in the art, and thus the body 100 is not limited to any particular shape. The shape of the lid 200 may have the same corresponding shape as the body 100.

The portable storage case 10 may be of a compact size that fits for example, into a jacket pocket, pant pocket, attaché case or handbag. In one embodiment, the portable storage container 10 has the dimension of a cigarette carton. For example, when the lid 200 is closed, the container 10 has the following dimension: 65 mm (width)×85-90 mm (height)×24 mm (depth). However, the portable storage case can be of any desirable dimensions.

In one embodiment, the portable storage case 10 is made of a combination of zinc alloy, stainless steel, brushed aluminum metals, plastics and polyvinyl chloride (PVC) materials for durability and strength. In another embodiment, the portable storage case 10 is made of high-grade plastic. In other embodiments, the portable storage case 10 may be composed of stainless steel or a combination of both stainless steel and high-grade plastic. The portable storage case 10 may be made of any materials that are known to have lasting durability and hardness.

As further illustrated, housed inside the body 100 are a built-in rechargeable battery 106 to power a build-in lighter 108, a compartment 110 for storing tools needed to prepare the substance, and a removable container 112 having a sealable stopper 114 for storing the substance.

FIGS. 10A to 11B are cross perspective view illustrating a control unit 300 located inside the body 100 in accordance with one embodiment. The control unit 300 is connected to a power switch 116 on an outer surface of the body 100 by an electrical means such as a circuit and to the lighter 108. In one embodiment, when the power switch 116 is turned on for example by depressing and releasing the power switch 116, the control unit 300 receives an activation signal from the power switch 116 and enables the lighter 108 to light. When the power switch 116 is turned off for example by depressing and releasing the power switch 116, the control unit 300 receives a deactivation signal from the power switch 116 and disables the lighter 108.

In one embodiment, the built-in rechargeable battery 106 is a lithium battery. In other embodiments, the build-in rechargeable battery 106 can be a lead-acid, nickel-cadmium (NiCd), nickel-metal hydride (NiMH), lithium ion or lithium-ion polymer (Li-ion polymer) battery. Any built-in rechargeable batteries known in the art may be used.

Figure 13:
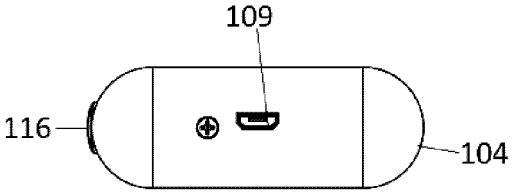
FIG. 13 is a bottom view of the portable storage case of FIG. 1.

In some embodiments, the bottom end 104 of the body 100 is equipped with a charging port 109 for charging the built-in rechargeable battery 106 to an external power source. The charging port 109 may be a USB port. In some embodiments, a USB cable is provided together with the portable storage case. Although the charging port 108 is shown in FIG. 13 as being in the bottom end 104 of the body 100, it can be at any outer surface of the body 100.

Figure 15:
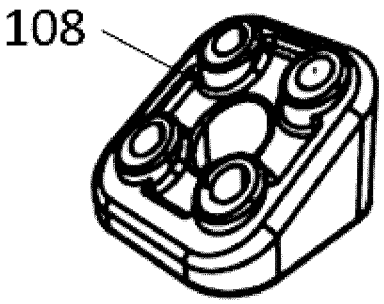
FIG. 15 is a close-up view of a built-in lighter according to one embodiment of the present disclosure.

As can be appreciated by the skilled person, the built-in lighter 108 provides a ready access to light rolled legal substances. In some embodiments, the lighter is an electric lighter such as an electric arc lighter that provides a flameless and windproof lighting experience (see FIG. 15 for an illustration of embodiment of the electric arc lighter). In one embodiment, the lighter is charged via a USB port (FIG. 13). In some embodiments, a USB cable is provided together with the portable storage case.

The compartment 110 can be used to store smoking accessories, for example, rolling papers, pre-rolled cones. The compartment 110 can be built-in or removable and can be of any desirable shape that fit within the body 100 together with other components contained in the body 100. The compartment 110 can be made of high-grade plastic, silicone, stainless steel or glass. It may be made of any material as would be appreciated by one of ordinary skill in the art.

The removable storage container 112 can be used to store legal substances or pre-rolled legal substances. The removable storage container 112 may be of any desirable shape that fit within the body 100 together with the other components contained with the body 100. In one embodiment, the sealable stopper 114 is provided to the removable storage container 112 so as to provide a seal such that the legal substances within the removable storage container 112 remain odorless to the outside environment. The sealable stopper 114 may also be used to prevent moisture in the atmosphere from entering the removable storage container 112. The stopper 114 may also have vacuum capabilities to provide a tighter seal. The vacuum capabilities may be added to the stopper 114 by any means known in the art. In some embodiments, as some of the legal substances have a particular scent or odor, the stopper 114 can provide a scent or odor proof seal. An exemplary scent or odor proof seal is an airtight seal. As can be appreciated by the person of ordinary skill in the art, the removable storage container 112 can allow an easy transfer of the substance to be carried and used with the portable storage container 10.

Figure 14A:
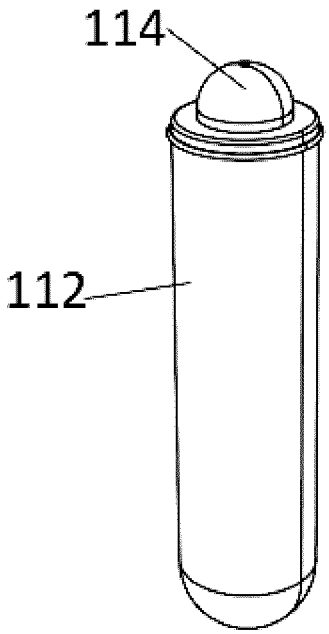
FIGS. 14A and 14B are perspective views of a removable container according to one embodiment of the present disclosure.
Figure 14B:
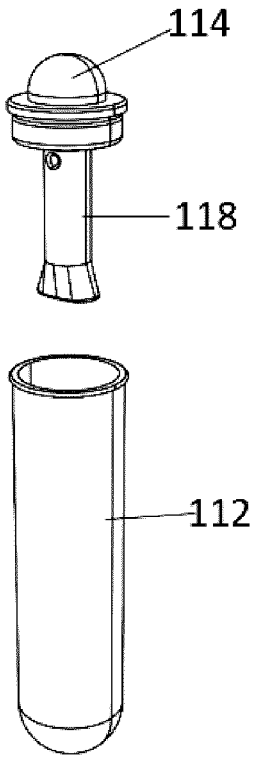

FIGS. 14A and 14B illustrate an exemplary removable storage container 112 equipped with an exemplary sealable stopper 114 in accordance with one particular embodiment. As illustrated, the sealable stopper 114 has a smoking tip 118 installed on an underside of the stopper. When the sealable stopper 114 seals the removable storage container 112, the smoking tip 118 extends into the portable storage container 112. The smoking tip 118 may be made of glass or any other materials known in the art.

The removable storage container 112 may be made of stainless steel, food grade plastic, glass or other materials that are known to be compatible with the legal substances. The stopper 114 may be made of the same or different material as the removable storage container 112. In one instance, the stopper 114 is made of silicone, for example, food grade silicone.

Figure 16A:
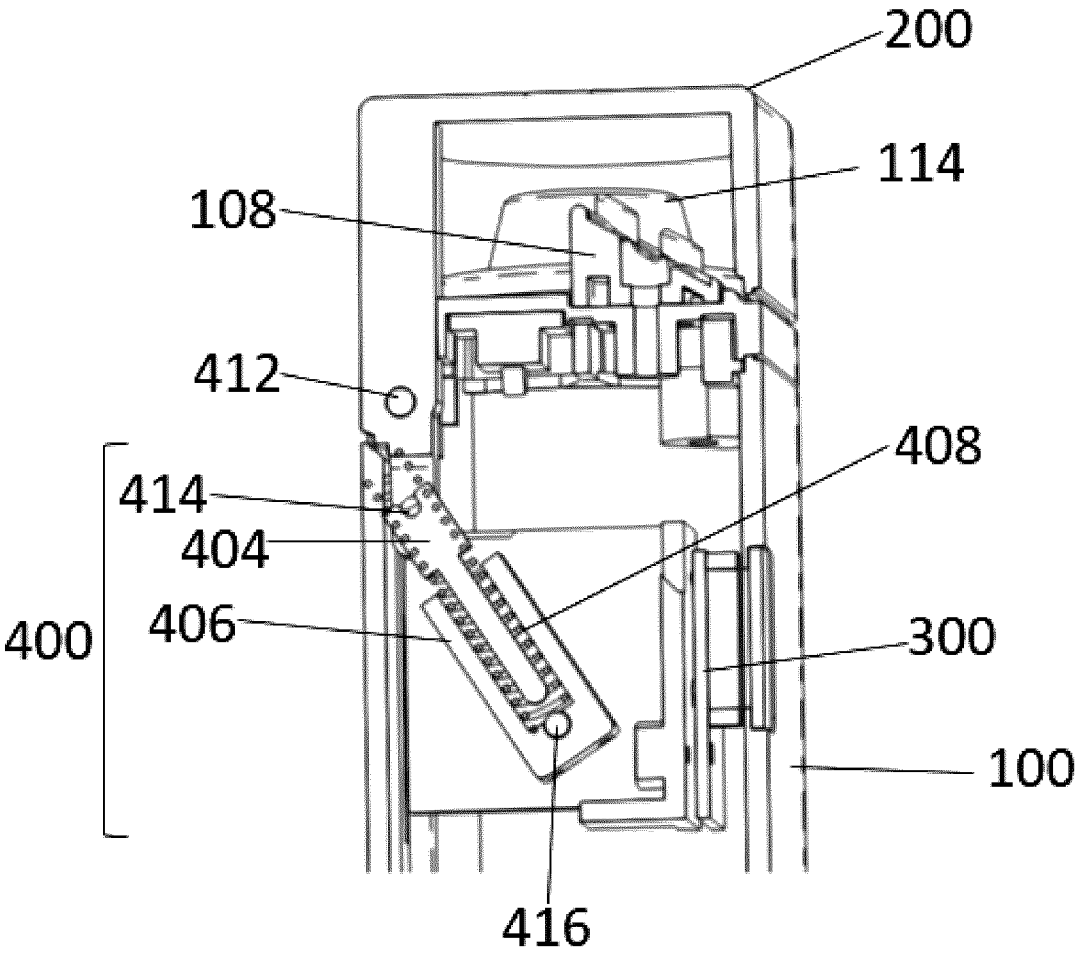
FIGS. 16A and 16B are schematic representations of the built-in safety mechanism of the portable storage case of FIG. 1.
Figure 16B:
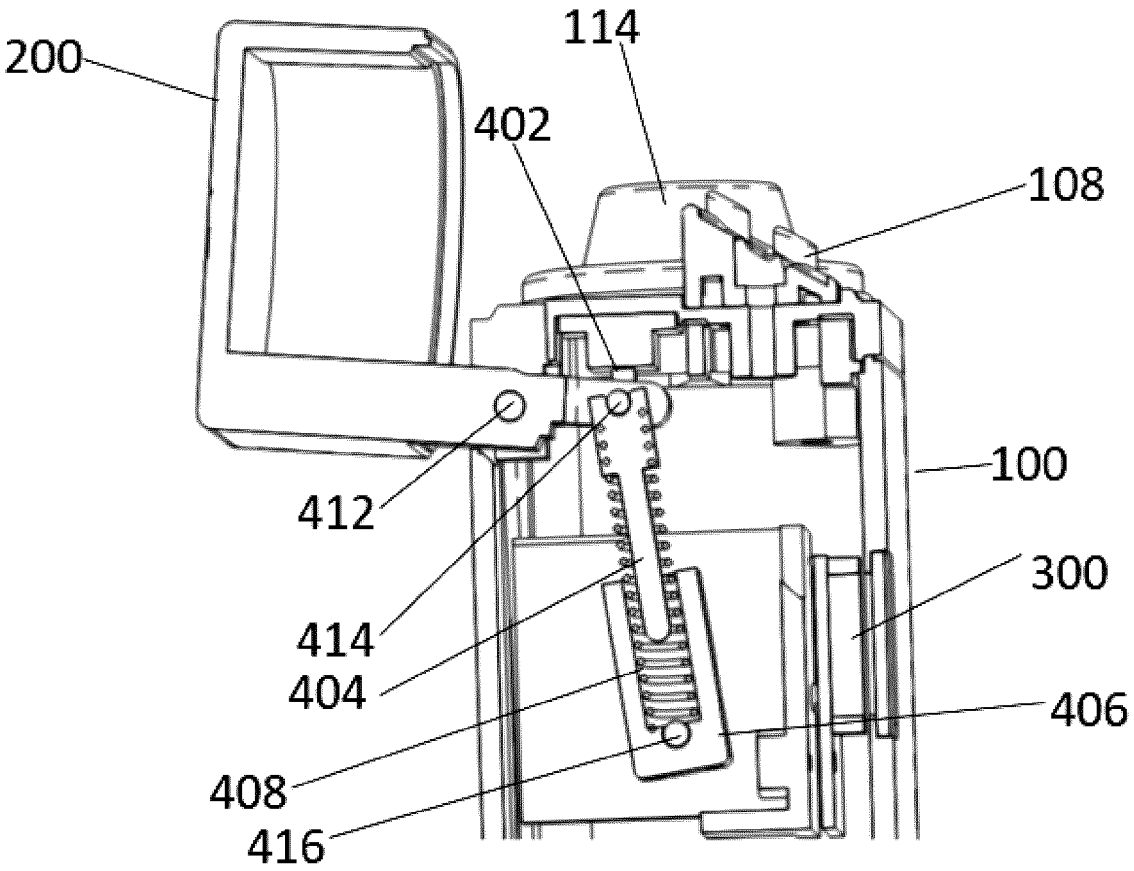

Referring to FIGS. 16A and 16B, in one embodiment, the portable storage case 10 further comprises a built-in safety mechanism 400 located in the body 100 and connected to a trigger switch 402 on the control unit 300 to prevent accidental activation of the lighter 108 when the lid 200 covers the opening end 102. One example of such accidental activation of the lighter 108 is when the power switch 116 is continuously pressed. In one embodiment, the trigger switch 402 can be activated through a contact communication with the lid 200 when the lid 200 uncovers the opening end 102. This in turn disables the built-in safety mechanism 400.

Figure 17:
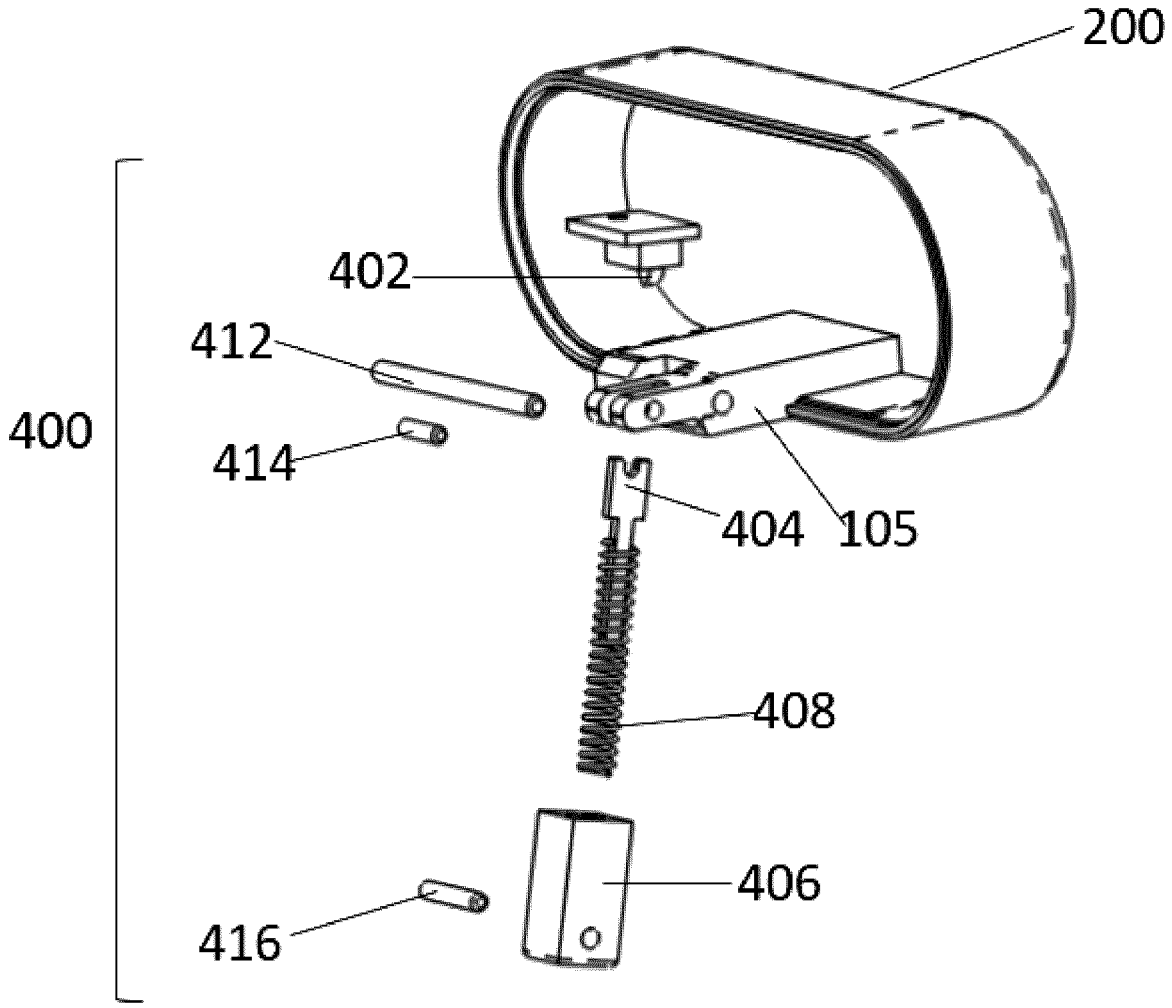
FIG. 17 is an explored view showing the built-in safety mechanism of the portable storage case of FIG. 1.

FIG. 17 is an exploded view showing the components of the built-in safety mechanism 400 in accordance with one particular embodiment. The build-in safety mechanism 400 comprises a first member 404 that is connected to the lid 200 via a first shaft 412 and a second shaft 414, and a second member 406 having an inner cavity to receive the first member 404. In one embodiment, the second member 406 is positioned on the control unit 300. In another embodiment, the second member 406 is affixed to the control unit by a third shaft 416.

In one embodiment, when the lid 200 is opened, it is in contact communication with the trigger switch 402 on the control unit 300, thereby deactivating the built-in safety mechanism 400. However, when the lid 200 is lowered to close the opening end 102, being connected to the lid 200, the first member 404 is also lowered and extends into the inner cavity of the second member 406. Consequently, the lid 200 is no longer in contact communication with the trigger switch 402. Therefore, the built-in safety mechanism 400 is no longer deactivated.

In some embodiments, as a further safety feature, when the power switch 116 is continuously pressed, the built-in lighter 108 is only enabled for no more than 8 seconds.

In some embodiments, the control unit comprises a battery level detector to detect the battery level of the built-in rechargeable battery 106. The body 100 comprises a battery level display 120 on the outer surface of the body 100. The battery level detector can communicate with the battery level display 120 such that the battery level detected is shown on the display 120. The display may be a digital display such as a LCD digital display.

By way of example only, the control unit 300 may be a printed circuit board comprising at least one integrated circuit. The integrated circuits may independently or in combination control the activation of the built-in lighter 108. In one embodiment, the at least one integrated circuit may be a microprogrammed control unit.

In another embodiment of the portable storage case 100, the built-in rechargeable battery 106 and the control unit 300 are located inside in the lid, the power switch 116 is on an outer surface of the lid 200 and the removable container 112 is located inside the compartment 110 for storing the tools in the body 100. The portable storage case having this configuration may be as compact as the size of a lipstick.

Additional, the portable storage case 10 may be part of a kit. The kit may also comprise the tools and/or accessories for preparing and using the legal substance. Exemplary tools and/or accessories may include rolling papers, cones, grinder, smoking tips, and other commonly used tools and/or accessories for smoking the legal substance.

While the principles of the invention have been shown and described in connection with specific embodiments, it is to be understood that such embodiments are by way of example and are not limiting. As is evident from the foregoing description, certain aspects of the present invention are not limited by the particular details of the invention illustrated in the drawings. Other modifications and applications, or equivalents, will occur to those skilled in the art. The terms "having", "comprising" and "including" and similar terms as used in the foregoing specification are used in the sense of "optional" or "may include" and not as "required". Many changes, modifications, variations and other uses and applications of the present construction will, however, become apparent to those skilled in the art after considering the specification and attached drawings. All such changes, modifications, variations and other uses and applications which do not depart from the spirit and scope of the invention are deemed to be covered by the invention which is limited only by the claims that follow. The scope of the disclosure is not intended to be limited to the embodiments shown herein, but is to be accorded the full scope consistent with the claims, wherein reference to an element in the singular is not intended to mean "one and only one" unless specifically so stated, but rather one or more.

The invention claimed is:

1. A portable storage case comprising:

a body having an opening end and a bottom end opposite to the opening end;

a lid attached to a side of the body, the lid being configured to cover and uncover the opening end;

a built-in rechargeable battery to power a built-in lighter, a compartment for storing tools needed to prepare a substance for recreational or medical use, and a removable container having a sealable stopper for storing the substance, all being located in the body, wherein the lighter is connected to a control unit located inside the body and connected to a power switch on an outer surface of the body, wherein when the power switch is turned on, the control unit receives an activation signal from the power switch and enables the lighter, and when the power switch is turned off, the control unit receives a deactivation signal from the power switch and disables the lighter; and a built-in safety mechanism inside the body and connected to a trigger switch on the control unit to prevent accidental activation of the lighter when the lid covers the opening end, the trigger switch being activated through a contact communication with the lid when the lid uncovers the opening end, which in turn disables the built-in safety mechanism; wherein the built-in safety mechanism comprises: a first member connected to the lid; and a second member having an inner cavity to receive the first member; wherein the covering of the opening end by the lid lowers the first member into the inner cavity of the second member, causing the trigger switch to lose contact communication with the lid, and the uncovering of the opening end raises the first member from the inner cavity of the second member, causing the trigger switch to be in contact communication with the lid.

2. The portable storage case of claim 1, wherein the first member is an elastic putter encased in a spring.

3. The portable storage case of claim 1, wherein the bottom end is equipped with a charging port for charging the built-in rechargeable battery to an external power source.

4. The portable storage case of claim 1, wherein the control unit further comprises a battery level detector to detect the battery level of the built-in rechargeable battery, and the body further comprises a battery level display on the outer surface of the body, the battery level detector communicates with the battery level display such that the battery level detected is shown on the display.

5. The portable storage case of claim 1, wherein the sealable stopper provides a scent proof seal.

6. The portable storage case of claim 1, wherein the sealable stopper further comprises a smoking tip extending from an underside of the stopper.

7. The portable storage case of claim 1, wherein the built-in lighter is an electric arc lighter.

8. The portable storage case of claim 1, wherein the control unit comprises a printed circuit board comprising at least one integrated circuit.

9. The portable storage case of claim 1, wherein the built-in rechargeable battery to power the lighter and the control unit are located inside the body, the power switch is on an outer surface of the body and the removable container is located inside the compartment for storing the tools in the body.

10. The portable storage case of claim 1, wherein the built-in rechargeable battery is a lithium-ion polymer battery.

11. A kit for storing, preparing and using the substance for recreational or medical use, the kit comprising the portable storage case of claim 1 and the tools.

* * * * *